US008508420B2

(12) United States Patent
Fujieda et al.

(10) Patent No.: US 8,508,420 B2
(45) **Date of Patent: *Aug. 13, 2013**

(54) ANTENNA DEVICE AND WIRELESS COMMUNICATION APPARATUS

(75) Inventors: Shigeyuki Fujieda, Hakusan (JP); Kazunari Kawahata, Yokohama (JP); Kenichi Ishizuka, Yokohama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 133 days.

This patent is subject to a terminal disclaimer.

(21) Appl. No.: 12/352,888

(22) Filed: Jan. 13, 2009

(65) Prior Publication Data

US 2009/0115674 A1 May 7, 2009

Related U.S. Application Data

(63) Continuation of application No. PCT/JP2007/058312, filed on Apr. 17, 2007.

(30) Foreign Application Priority Data

Jul. 13, 2006 (JP) ..... 2006-192433

(51) Int. Cl.

| | |
|---|---|
| ***H01Q 9/00*** | (2006.01) |
| ***H01Q 1/24*** | (2006.01) |
| ***H01Q 21/00*** | (2006.01) |
| ***H01Q 1/38*** | (2006.01) |

(52) U.S. Cl.

USPC ..... 343/745; 343/702; 343/750; 343/826; 343/853; 343/700 MS

(58) Field of Classification Search

USPC ..... 343/702, 745, 750, 826, 853, 700 MS

See application file for complete search history.

(56) References Cited

U.S. PATENT DOCUMENTS

| | | | | |
|---|---|---|---|---|
| 6,462,716 | B1 * | 10/2002 | Kushihi | 343/860 |
| 2003/0117325 | A1 * | 6/2003 | Jo et al. | 343/702 |

(Continued)

FOREIGN PATENT DOCUMENTS

| | | |
|---|---|---|
| JP | 2002-158529 | 5/2002 |
| JP | 2004-165965 | 6/2004 |

(Continued)

OTHER PUBLICATIONS

"Capacitors and Capacitance," John D. Kraus, Electromagnetics, Second Edition, McGraw Hill, 1973.*

(Continued)

*Primary Examiner* — Jacob Y Choi
*Assistant Examiner* — Graham Smith
(74) *Attorney, Agent, or Firm* — Keating & Bennett, LLP

(57) ABSTRACT

An antenna device and a wireless communication apparatus that are capable of obtaining a plurality of resonant frequencies and varying the plurality of resonant frequencies over a wide range are provided. A first antenna unit of an antenna device includes a feed electrode, a first radiation electrode, and a first frequency-variable circuit. The first frequency-variable circuit includes first and second reactance circuits each including a variable-capacitance diode. A control voltage is applied to the first frequency-variable circuit, and the resonant frequency of the first antenna unit can thus be varied. A second antenna unit includes the feed electrode, a second radiation electrode, and a second frequency-variable circuit. The second frequency-variable circuit includes first and third reactance circuits each including a variable-capacitance diode. A control voltage is applied to the second frequency-variable circuit, and the resonant frequency of the second antenna unit can thus be varied.

6 Claims, 9 Drawing Sheets

(56) References Cited

U.S. PATENT DOCUMENTS

| | | | | |
|---|---|---|---|---|
| 2004/0090382 | A1 | 5/2004 | Kushihi et al. | |
| 2005/0078034 | A1 | 4/2005 | Imaizumi et al. | |
| 2006/0017621 | A1 * | 1/2006 | Okawara et al. ..... | 343/700 MS |

FOREIGN PATENT DOCUMENTS

| | | | |
|---|---|---|---|
| JP | 2005-020266 | | 1/2005 |
| JP | 2006-005756 | | 1/2006 |
| JP | 2006-60384 | | 3/2006 |
| JP | 2006-180077 | | 7/2006 |
| JP | 2006-270916 | A | 10/2006 |
| WO | 03/034539 | | 4/2003 |
| WO | 2004/109850 | | 12/2004 |

OTHER PUBLICATIONS

"Impedance and Admittance," Basic Engineering Circuit Analysis, 7th Edition, A Wiley First Edition, Irwin John, Wiley and Sons, 2002.*

Written Opinion issued Jul. 17, 2007 with English language translation.

International Search Report issued Jul. 17, 2007 with English language translation.

Official Communication issued in corresponding Japanese Patent Application No. 2007-550607, mailed on Jul. 13, 2010.

* cited by examiner

ANTENNA DEVICE AND WIRELESS COMMUNICATION APPARATUS

CROSS-REFERENCE TO RELATED APPLICATIONS

This is a continuation under 35 U.S.C. §111(a) of PCT/JP2007/058312 filed Apr. 17, 2007, and claims priority of JP2006-192433 filed Jul. 13, 2006, both incorporated by reference.

BACKGROUND

1. Technical Field

Disclosed are an antenna device and a wireless communication apparatus that are capable of varying a resonant frequency over a certain range.

2. Background Art

As an antenna device of this type, for example, a frequency-variable antenna disclosed in Patent Document 1 has been available. The antenna device has a configuration in which a feed electrode and a single radiation electrode are formed on a substrate and a single frequency-variable circuit is disposed between the feed electrode and the radiation electrode.

With this configuration, varying a control voltage to be applied to a variable-capacitance diode contained in the frequency-variable circuit varies a resonant frequency of the antenna.

Patent Document 1: Japanese Unexamined Patent Application Publication No. 2006-060384

SUMMARY

However, the above-described antenna device has the problems described below.

Since the antenna device includes a feed electrode, a frequency-variable circuit, and a single radiation electrode, only a single resonant frequency can be obtained. In addition, although the resonant frequency can be varied using the frequency-variable circuit, since the frequency-variable circuit, which has only a single variable-capacitance diode, is used, the resonant frequency cannot be varied over a wide range.

In order to solve the above-mentioned problems, it is desired to provide an antenna device and a wireless communication apparatus that are capable of obtaining a plurality of resonant frequencies and varying the plurality of resonant frequencies over a wide range.

In order to solve the above-mentioned problems, an antenna device may include a first antenna unit including a feed electrode connected to a feed unit, a first radiation electrode, and a first frequency-variable circuit connected between the first radiation electrode and the feed electrode; and a second antenna unit including the feed electrode, a second radiation electrode, and a second frequency-variable circuit connected between the second radiation electrode and the feed electrode. The first frequency-variable circuit includes a first reactance circuit connected to the feed electrode, the first reactance circuit including a first variable-capacitance diode whose capacitance is variable using a control voltage; and a second reactance circuit connected between the first reactance circuit and the first radiation electrode, the second reactance circuit including a second variable-capacitance diode whose capacitance is variable using the control voltage. The second frequency-variable circuit includes the first reactance circuit; and a third reactance circuit connected between the first reactance circuit and the second radiation electrode, the third reactance circuit including a third variable-capacitance diode whose capacitance is variable using the control voltage.

With this configuration, when electric power is supplied from the feed unit to the feed electrode, the first antenna unit resonates with electric power at a frequency and transmits an electric wave at the frequency. In addition, the second antenna unit resonates with electric power at a frequency that is different from the resonant frequency of the first antenna unit and transmits an electric wave at the different frequency. That is, the antenna device is capable of achieving a two-resonant frequency state exhibiting a resonant frequency of the first antenna unit and a resonant frequency of the second antenna unit. In addition, since the capacitance of the second variable-capacitance diode of the second reactance circuit, as well as the capacitance of the first variable-capacitance diode of the first reactance circuit, can be varied using a control voltage, a large reactance change for two variable-capacitance diodes can be achieved by the first frequency-variable circuit. As a result, the resonant frequency of the first antenna unit can be varied over a wide range. In addition, since the capacitance of the first variable-capacitance diode of the first reactance circuit and the capacitance of the third variable-capacitance diode of the third reactance circuit are controlled using the control voltage, a large reactance change for two variable-capacitance diodes can be achieved by the second frequency-variable circuit. As a result, the resonant frequency of the second antenna unit can also be varied over a wide range.

In the antenna device, the second variable-capacitance diode of the second reactance circuit and the third variable-capacitance diode of the third reactance circuit may be disposed so as to associate with the first variable-capacitance diode of the first reactance circuit, cathodes of the first to third variable-capacitance diodes may be connected to each other, and the control voltage may be applied to a portion where the cathodes are connected to each other.

With this configuration, the three variable-capacitance diodes of the first to third variable-capacitance diodes can be varied at the same time using the control voltage.

Further, the first reactance circuit may be a series resonant circuit or a parallel resonant circuit including the first variable-capacitance diode, the second reactance circuit may be a series resonant circuit or a parallel resonant circuit including the second variable-capacitance diode, and the third reactance circuit may be a series resonant circuit or a parallel resonant circuit including the third variable-capacitance diode.

With this configuration, when all the first to third reactance circuits are configured as series resonant circuits, a large gain can be obtained without greatly increasing variable ranges of the resonant frequency of the first antenna unit and the resonant frequency of the second antenna unit. When all the first to third reactance circuits are configured as parallel resonant circuits, variable ranges of the resonant frequency of the first antenna unit and the resonant frequency of the second antenna unit can be increased although a large gain is not obtained. Thus, when at least one of the first to third reactance circuits is configured as a series resonant circuit and the others of the first to third reactance circuits are configured as parallel resonant circuits, the amount of change in the resonant frequency of the first antenna unit can be made different from the amount of change in the resonant frequency of the second antenna unit.

In addition, each of the first to third reactance circuits may be configured as a parallel resonant circuit in which a coil is connected in parallel to a series circuit including the corresponding variable-capacitance diode, and at least one of the coils of the first to third reactance circuits may be provided by a choke coil and the corresponding reactance circuit including the coil may serve substantially as a series resonant circuit.

With this configuration, when the coil of the parallel resonant circuit is used as a choke coil, a reactance circuit including the coil is substantially capable of serving as a series resonant circuit. Thus, design can be easily changed without requiring reconfiguration of a parallel resonant circuit portion into a series resonant circuit.

According to another feature, an internal resistance of at least one of the first to third variable-capacitance diodes may be different from internal resistances of the others of the first to third variable-capacitance diodes. When the internal resistance of a variable-capacitance diode is reduced, although a gain is increased, a variable-capacitance range becomes narrower. In contrast, when the internal resistance is increased, although a gain is reduced, a variable capacitance range becomes wider. Thus, with this configuration, the internal resistance of at least one of the first to third variable-capacitance diodes may be made different from the internal resistances of the others of the first to third variable-capacitance diodes, according to whether a frequency variable range or a gain is to be emphasized, so that characteristics of the first antenna unit and the second antenna unit can be obtained according to the intended use.

According to a further feature, at least the first antenna unit may be formed on a dielectric substrate.

With this configuration, the capacitance of at least the first antenna unit can be increased, and the reactance of the first antenna unit can be increased.

In the antenna device, an additional radiation electrode may be connected to a stage subsequent to the first reactance circuit, which is connected to the feed electrode, and an additional antenna unit may be formed by the additional radiation electrode, the feed electrode, and the first reactance circuit, which is a frequency-variable circuit.

With this configuration, the resonant frequency of the additional antenna unit, as well as the resonant frequencies of the first and second antenna units, can be obtained. Thus, electric waves of more resonant frequencies can be handled. In addition, the resonant frequencies of the first and second antenna unit and the resonant frequency of the additional antenna unit can be varied at the same time.

Moreover, a plurality of additional antenna units may be provided, and in at least one of the plurality of additional antenna units, an additional reactance circuit including a variable-capacitance diode whose capacitance is variable using the control voltage may be connected between the first reactance circuit and the corresponding additional radiation electrode, and a frequency-variable circuit of the at least one of the plurality of additional antenna units may be formed by the additional reactance circuit and the first reactance circuit.

With this configuration, since the frequency-variable circuit of the additional antenna unit is formed by the additional reactance circuit and the first reactance circuit, the resonant frequency of the additional antenna unit can be varied over a wide range.

A wireless communication apparatus may include the antenna device according to any one of the configurations described above.

As described above, since the antenna device includes a plurality of antenna units, an excellent advantage of obtaining a plurality of resonant frequencies can be achieved. Moreover, since a frequency-variable circuit of each of the plurality of antenna units includes two reactance circuits each including a variable-capacitance diode, a large reactance change for the two variable-capacitance diodes can be achieved. As a result, the resonant frequency of each of the plurality of antenna units can be varied over a wider range.

In addition, in the antenna device, a large gain can be obtained when all the first to third reactance circuits are configured as series resonant circuits, and a wide variable range of a resonant frequency can be achieved when all the first to third reactance circuits are configured as parallel resonant circuits. When both a series resonant circuit and a parallel resonant circuit are used, the amount of change in the resonant frequency and the gain of the first antenna unit can be made different from the amount of change in the resonant frequency and the gain of the second antenna unit. As a result, optimal characteristics can be achieved according to the intended use.

In addition, in the antenna device, there is no need to reconfigure a parallel resonant circuit portion into a series resonant circuit. Thus, a design change from a parallel resonant circuit into a series resonant circuit can be performed easily.

In addition, in the antenna device, characteristics of the first antenna unit and the second antenna unit can be obtained according to the intended use.

In addition, in the antenna device, the reactance of at least the first antenna unit can be increased. Thus, the resonant frequency of the first antenna unit can be reduced.

In addition, in the antenna device, a larger number of resonances can be obtained. Moreover, the resonant frequencies can be varied at the same time.

In particular, the resonant frequencies of the additional antenna units can be varied over a wide range.

In addition, in a wireless communication apparatus, transmission and reception can be performed such that a frequency change can be achieved over a wide range corresponding to the multi-resonances.

Other features and advantages will become apparent from the following description of embodiments, which refers to the accompanying drawings.

DETAILED DESCRIPTION

Reference Numerals

1: antenna device, 2: first antenna unit, 3: second antenna unit, 3-1 to **3-*n*: additional antenna unit, 4: feed electrode, 5: first radiation electrode, 6-1: first frequency-variable circuit, 6-2: second frequency-variable circuit, 6A: first reactance circuit, 6B: second reactance circuit, 6C: third reactance circuit, 6D and 6E: additional reactance circuit, 7: second radiation electrode, 8: dielectric substrate, 9 and 9-1 to 9-*n*: additional radiation electrode, 50: open end, 51, 71, and 91: ground coil, 61A: first variable-capacitance diode, 61B: second variable-capacitance diode, 61C: third variable-capacitance diode, 61D and 61E: variable-capacitance diode, 62A, 62B, 62C, 63A, 63B, and 63C: coil, 64: common capacitor, 100: circuit board, 101: non-ground region, 102: ground region, 110: transmitter/receiver, 120: reception-frequency controller, G: gap, P: connection point, S1: return-loss curve, S2: return-loss curve, Vc: control voltage, d1, d2, d3, d4, . . . and dn: amount of change, f1, f2, f3, f4**, . . . and fn: resonant frequency Several embodiments will now be described with reference to the drawings.

First Embodiment

Figure 1:
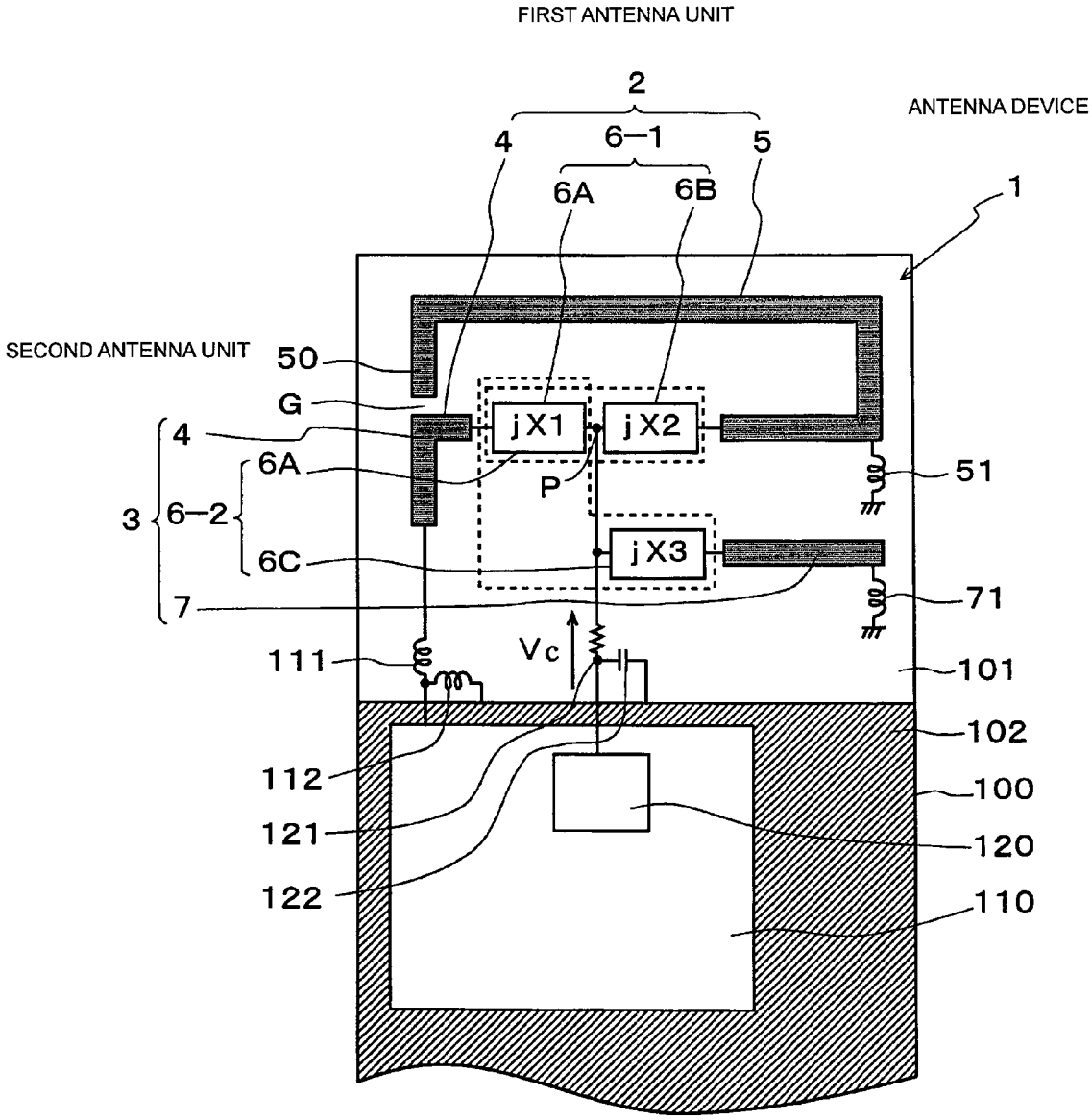
FIG. 1 is a schematic plan view showing an antenna device according to a first embodiment.

FIG. 1 is a schematic plan view showing an antenna device according to a first embodiment.

An antenna device 1 according to this embodiment is provided in a wireless communication apparatus, such as a cellular phone.

As shown in FIG. 1, the antenna device 1 is formed in a non-ground region 101 of a circuit board 100 of the wireless communication apparatus. The antenna device 1 transfers high-frequency signals to and from a transmitter/receiver 110, which is provided in a ground region 102 and serves as a power-feed unit. A reception-frequency controller 120 provided in the transmitter/receiver 110 applies a direct-current control voltage Vc to the antenna device 1.

The antenna device 1 includes a first antenna unit 2 and a second antenna unit 3.

The first antenna unit 2 includes a feed electrode 4, a first radiation electrode 5, and a first frequency-variable circuit 6-1 connected between the feed electrode 4 and the first radiation electrode 5.

More specifically, a matching circuit including coils 111 and 112 is formed in the non-ground region 101, and the feed electrode 4, which is a conductive pattern, is connected to the transmitter/receiver 110 through the matching circuit.

The first radiation electrode 5 is a conductive pattern having a loop shape. An open end 50 of the first radiation electrode 5 faces the feed electrode 4 with a gap G therebetween. The gap G causes a capacitance between the feed electrode 4 and the first radiation electrode 5. By varying the size of the gap G, the reactance of the first antenna unit 2 can be set to a desired value. A ground coil 51, which is provided for resonant frequency adjusting, is connected in the middle of the first radiation electrode 5.

The first frequency-variable circuit 6-1 includes a first reactance circuit 6A (represented by "jX1" in FIG. 1), which is connected to the feed electrode 4, and a second reactance circuit 6B (represented by "jX2" in FIG. 1), which is connected between the first reactance circuit 6A and the first radiation electrode 5. The first reactance circuit 6A includes a first variable-capacitance diode, which is not shown. When a control voltage Vc is applied to the first variable-capacitance diode, the capacitance of the first variable-capacitance diode increases or decreases, resulting in a change in the reactance of the first reactance circuit 6A.

The second reactance circuit 6B includes a second variable-capacitance diode, which is not shown. When a control voltage Vc is applied to the second variable-capacitance diode, the capacitance of the second variable-capacitance diode increases or decreases, resulting in a change in the reactance of the second reactance circuit 6B.

A connection point P between the first reactance circuit 6A and the second reactance circuit 6B is connected to the reception-frequency controller 120 through a high-frequency cut-off resistor 121 and a DC-pass capacitor 122.

With this configuration, when the reception-frequency controller 120 applies a control voltage Vc to the connection point P, the reactances of the first and second reactance circuits 6A and 6B increase or decrease in accordance with the size of the control voltage Vc, resulting in a change in the reactance of the entire first frequency-variable circuit 6-1, as described above. That is, applying the control voltage Vc to the first frequency-variable circuit 6-1 varies the electrical length of the first antenna unit 2, thus varying the resonant frequency of the first antenna unit 2.

The second antenna unit 3 includes the feed electrode 4, a second radiation electrode 7, and a second frequency-variable circuit 6-2 connected between the feed electrode 4 and the second radiation electrode 7.

More specifically, the second radiation electrode 7 is a conductive pattern having a line shape. A ground coil 71, which is provided for resonant frequency adjusting, is connected to an end of the second radiation electrode 7.

The second frequency-variable circuit 6-2 includes the first reactance circuit 6A and a third reactance circuit 6C (represented by "jX3" in FIG. 1), which is connected between the first reactance circuit 6A and the second radiation electrode 7.

Similarly to the first reactance circuit 6A, the third reactance circuit 6C includes a third variable-capacitance diode, which is not shown. When a control voltage Vc is applied to the third variable-capacitance diode, the capacitance of the third variable-capacitance diode increases or decreases, resulting in a change in the reactance of the third reactance circuit 6C.

The third reactance circuit 6C is also connected to the connection point P between the first reactance circuit 6A and the second reactance circuit 6B. When the reception-frequency controller 120 applies a control voltage Vc to the connection point P, the reactances of the first and third reactance circuits 6A and 6C increase or decrease in accordance with the size of the control voltage Vc, resulting in a change in the reactance of the entire second frequency-variable circuit 6-2. That is, applying the control voltage Vc to the second frequency-variable circuit 6-2 varies the electrical length of the second antenna unit 3, thus varying the resonant frequency of the second antenna unit 3.

Operations and advantages of the antenna device according to this embodiment will be described.

Figure 2:
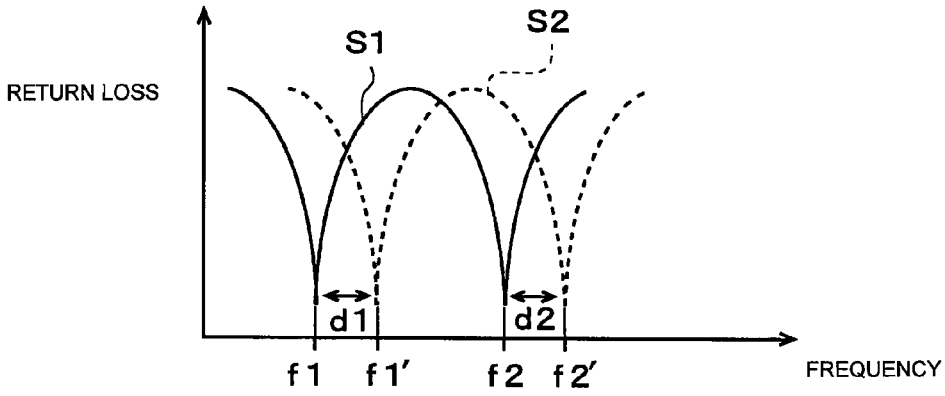
FIG. 2 is a chart illustrating a variable state of two resonances.

FIG. 2 is a chart illustrating a variable state of two resonances.

As described above, the first antenna unit 2 includes the feed electrode 4, the first frequency-variable circuit 6-1, and the first radiation electrode 5, and the second antenna unit 3 includes the feed electrode 4, the second frequency-variable circuit 6-2, and the second radiation electrode 7. With this configuration, a two-resonant frequency state exhibiting a resonant frequency f1 of the first antenna unit 2 and a resonant frequency f2 of the second antenna unit 3 can be achieved.

For example, when the length of the first radiation electrode 5 is set to be longer than the length of the second radiation electrode 7, the resonant frequency f1 of the first antenna unit 2 is lower than the resonant frequency f2 of the second antenna unit 3. In this case, a return-loss curve S1 represented by a solid line shown in FIG. 2 is obtained.

When a control voltage Vc is applied to the first frequency-variable circuit 6-1, the reactances of the first and second reactance circuits 6A and 6B increase or decrease in accordance with the size of the control voltage Vc, resulting in a change in the reactance of the entire first frequency-variable circuit 6-1. Thus, the electrical length of the first antenna unit 2 is changed, and the resonant frequency f1 of the first antenna unit 2 is changed.

In parallel to this, the reactances of the first and third reactance circuits 6A and 6C of the second frequency-variable circuit 6-2 also increase or decrease in accordance with the size of the control voltage Vc, resulting in a change in the reactance of the entire second frequency-variable circuit 6-2. Thus, the electrical length of the second antenna unit 3 is changed, and the resonant frequency f2 of the second antenna unit 3 is changed.

As a result, as shown by a return-loss curve S2 represented by a broken line shown in FIG. 2, the resonant frequency f1 of the first antenna unit 2 moves by the amount of change d1, which corresponds to the size of the control voltage Vc, and reaches a frequency f1'. At the same time, the resonant frequency f2 of the second antenna unit 3 moves by the amount of change d2, which corresponds to the size of the control voltage Vc, and reaches a frequency f2'.

At this time, the amount of change d1, by which the resonant frequency f1 is changed to the resonant frequency f1' by the first frequency-variable circuit 6-1, is obtained not only from the amount of change in the capacitance of the first variable-capacitance diode included in the first reactance circuit 6A but also from the amount of change in the capacitance of the second variable-capacitance diode included in the second reactance circuit 6B. Similarly, at this time, the amount of change d2, by which the resonant frequency f2 is changed to the resonant frequency f2' by the second frequency-variable circuit 6-2, is obtained not only from the amount of change in the capacitance of the first variable-capacitance diode included in the first reactance circuit 6A but also from the amount of change in the capacitance of the third variable-capacitance diode included in the third reactance circuit 6C. Thus, the large amount of change d1 (or d2) can be obtained. As a result, the resonant frequency f1 (or f2) of the first antenna unit 2 (or the second antenna unit 3) can be varied over a wide range.

In the antenna device of the related art, only a single resonance appears and a resonant frequency is varied by a frequency-variable circuit including only a single variable-capacitance diode. Thus, in order to vary the resonant frequency over a wide range from f1 to f2', as shown in FIG. 2, a large control voltage Vc is necessary. Such an antenna device is not suitable for a wireless communication apparatus, such as a cellular phone, which requires a lower voltage specification.

In contrast, in the antenna device 1 according to this embodiment, the resonant frequencies f1 and f2 in the two-resonant frequency state can be varied at the same time by a predetermined control voltage Vc, as described above. Thus, a resonant frequency can be varied over a wide range from f1 to f2' by the application of a low control voltage Vc. Thus, the antenna device 1 according to this embodiment is suitable for a wireless communication apparatus, such as a cellular phone, which requires a lower power-supply voltage.

Second Embodiment

A second embodiment will be described.

Figure 3:
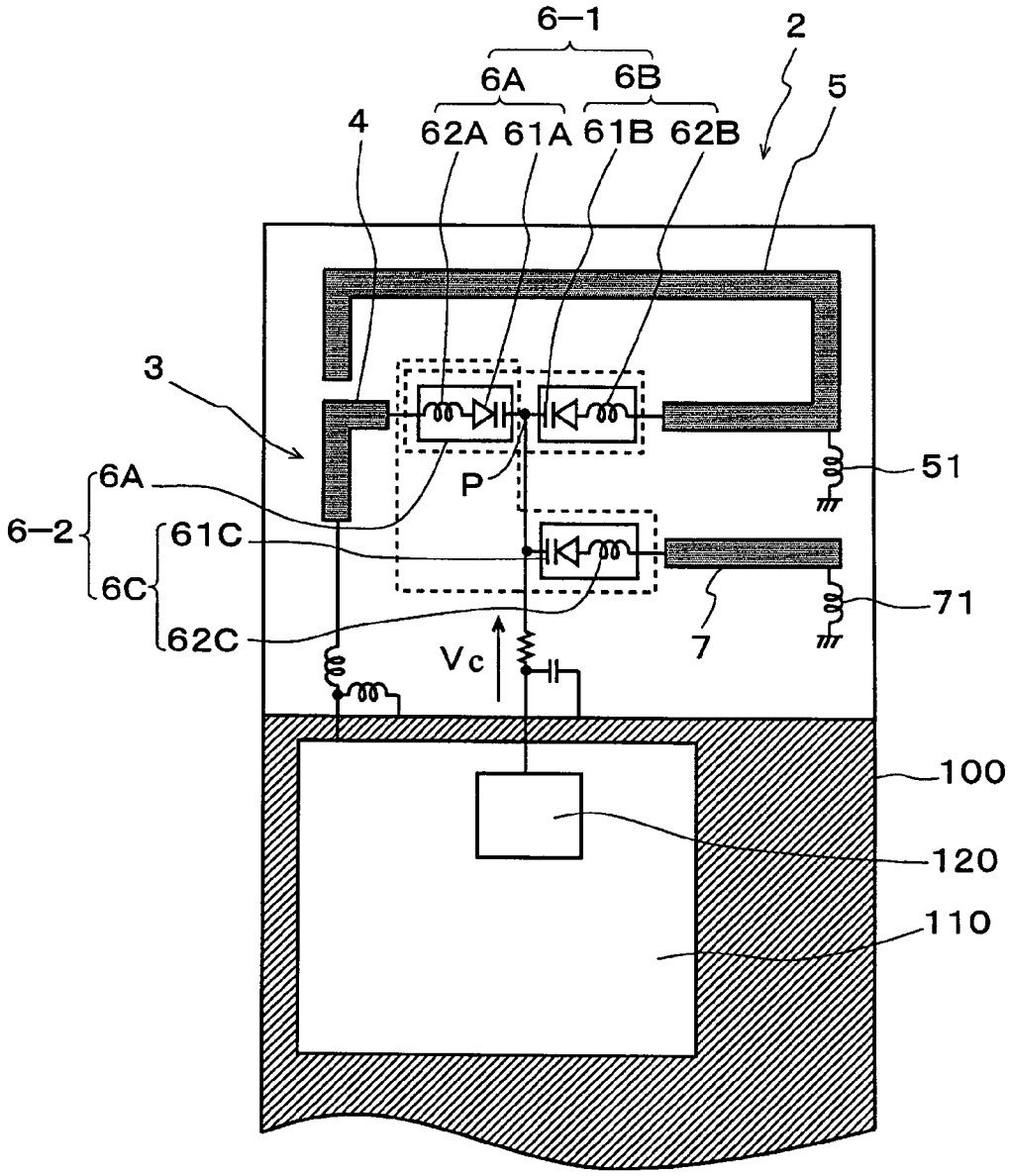
FIG. 3 is a schematic plan view showing an antenna device according to a second embodiment.

FIG. 3 is a schematic plan view showing an antenna device according to the second embodiment.

In the antenna device according to this embodiment, a concrete series resonant circuit is applied to each of the first reactance circuit 6A, the second reactance circuit 6B, and the third reactance circuit 6C used in the first embodiment.

As shown in FIG. 3, the first reactance circuit 6A, the second reactance circuit 6B, and the third reactance circuit 6C are configured as a series resonant circuit including a first variable-capacitance diode 61A, a series resonant circuit including a second variable-capacitance diode 61B, and a series resonant circuit including a third variable-capacitance diode 61C, respectively.

More specifically, a series resonant circuit including the first variable-capacitance diode 61A and a coil 62A is used as the first reactance circuit 6A. The coil 62A is connected to the feed electrode 4. The cathode of the first variable-capacitance diode 61A is connected to the connection point P. A series resonant circuit including the second variable-capacitance diode 61B and a coil 62B is used as the second reactance circuit 6B. The coil 62B is connected to the first radiation electrode 5. The cathode of the second variable-capacitance diode 61B is connected to the connection point P. A series resonant circuit including the third variable-capacitance diode 61C and a coil 62C is used as the third reactance circuit 6C. The coil 62C is connected to the second radiation electrode 7. The cathode of the third variable-capacitance diode 61C is connected to the connection point P.

That is, the second variable-capacitance diode 61B of the second reactance circuit 6B and the third variable-capacitance diode 61C of the third reactance circuit 6C are disposed so as to associate with the first variable-capacitance diode 61A of the first reactance circuit 6A. The cathodes of the first to third variable-capacitance diodes 61A to 61C are connected to each other. A control voltage Vc is applied to a portion where the cathodes are connected to each other.

Operations and advantages of the antenna device according to this embodiment will be described.

Figure 4:
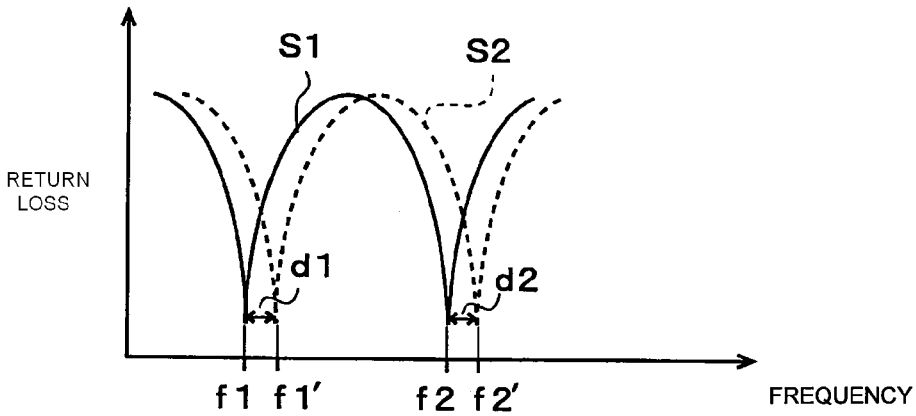
FIG. 4 is a chart illustrating a variable state of two resonances.

FIG. 4 is a chart illustrating a variable state of two resonances.

As shown by a return-loss curve S1 represented by a solid line shown in FIG. 4, in the antenna device according to this embodiment, a two-resonant frequency state exhibiting a resonant frequency f1 of the first antenna unit 2 and a resonant frequency f2 of the second antenna unit 3 can be achieved. Applying a control voltage Vc to each of the first frequency-variable circuit 6-1 and the second frequency-variable circuit 6-2 varies the resonant frequency f1 of the first antenna unit 2 and the resonant frequency f2 of the second antenna unit 3 at the same time.

In the series resonant circuit including the first variable-capacitance diode and the coil, the reactance with respect to the control voltage Vc varies substantially linearly. Thus, although the amount of change d1 (or d2) from the resonant frequency f1 to the resonant frequency f1' (or from f2 to f2') by the first frequency-variable circuit 6-1 (or the second frequency-variable circuit 6-2) is not very large, a large gain can be achieved. Consequently, in a case where all the first to third reactance circuits 6A to 6C are configured as series resonant circuits as in this embodiment, an antenna device in which a gain is emphasized can be achieved.

Since the other configurations, operations, and advantages of the antenna device according to this embodiment are similar to those of the antenna device according to the first embodiment, the description of those similar configurations, operations, and advantages will be omitted.

Third Embodiment

A third embodiment will be described.

Figure 5:
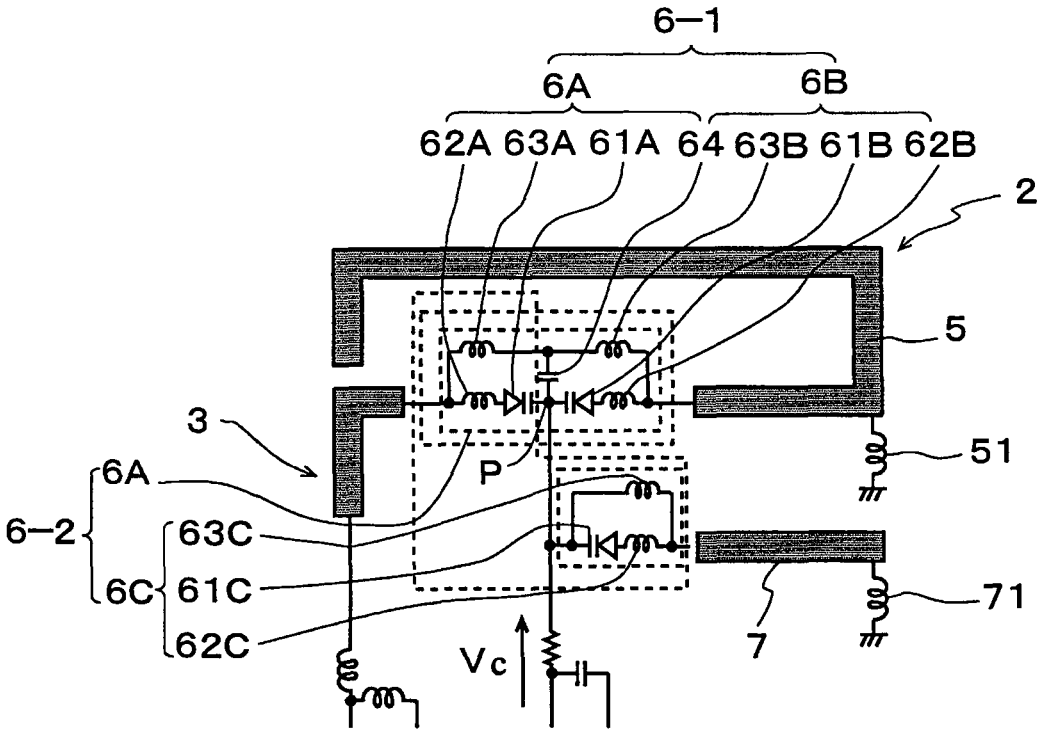
FIG. 5 is a schematic plan view showing an antenna device according to a third embodiment.

FIG. 5 is a schematic plan view showing an antenna device according to the third embodiment.

In the antenna device according to this embodiment, a concrete parallel resonant circuit is applied to each of the first reactance circuit 6A, the second reactance circuit 6B, and the third reactance circuit 6C used in the first embodiment.

That is, as shown in FIG. 5, the first reactance circuit 6A, the second reactance circuit 6B, and the third reactance circuit 6C are configured as a parallel resonant circuit including the first variable-capacitance diode 61A, a parallel resonant circuit including the second variable-capacitance diode 61B, and a parallel resonant circuit including the third variable-capacitance diode 61C, respectively.

More specifically, a parallel resonant circuit in which a series circuit including a coil 63A and a common capacitor 64 is connected in parallel to the series circuit including the first variable-capacitance diode 61A and the coil 62A is used as the first reactance circuit 6A. A parallel resonant circuit in which a series circuit including a coil 63B and the common capacitor 64 is connected in parallel to the series circuit including the second variable-capacitance diode 61B and the coil 62B is used as the second reactance circuit 6B. A parallel resonant circuit in which a coil 63C is connected in parallel to the series circuit including the third variable-capacitance diode 61C and the coil 62C is used as the third reactance circuit 6C.

Operations and advantages of the antenna device according to this embodiment will be described.

Figure 6:
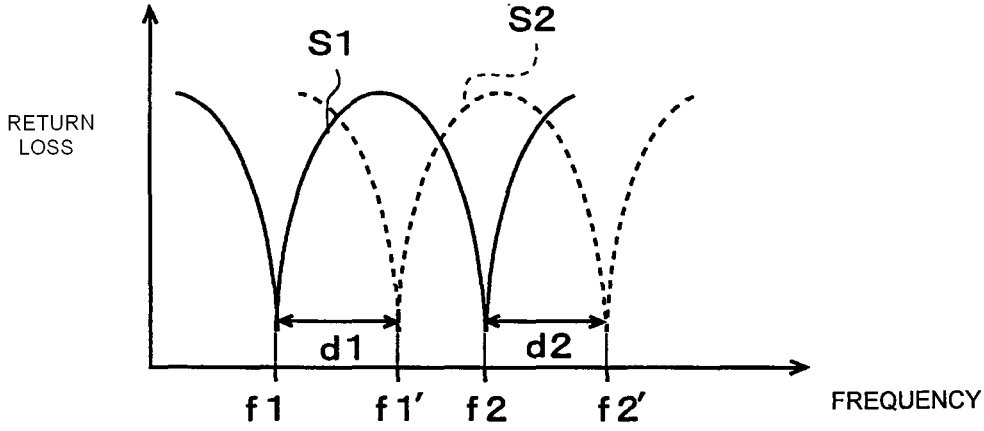
FIG. 6 is a chart illustrating a variable state of two resonances.

FIG. 6 is a chart illustrating a variable state of two resonances.

As shown by a return-loss curve S1 represented by a solid line shown in FIG. 6, the antenna device according to this embodiment achieves a two-resonant frequency state exhibiting a resonant frequency f1 of the first antenna unit 2 and a resonant frequency f2 of the second antenna unit 3, as in the first embodiment. Applying a control voltage Vc to each of the first frequency-variable circuit 6-1 and the second frequency-variable circuit 6-2 varies the resonant frequency f1 of the first antenna unit 2 and the resonant frequency f2 of the second antenna unit 3 at the same time.

In the parallel resonant circuit in which a series circuit including a variable-capacitance diode and a coil is connected in parallel to another coil, the reactance with respect to the control voltage varies nonlinearly. Thus, although a large gain is not obtained, a significantly large amount of change d1 (d2) from the resonant frequency f1 to the resonant frequency f1' (f2 to f2') by the first frequency-variable circuit 6-1 (the second frequency-variable circuit 6-2) can be achieved. Consequently, in a case where all the first to third reactance circuits 6A to 6C are configured as parallel resonant circuits as in this embodiment, an antenna device that is capable of varying a frequency over a wide range can be achieved.

Since the other configurations, operations, and advantages of the antenna device according to this embodiment are similar to those of the antenna devices according to the first and second embodiments, the description of those similar configurations, operations, and advantages will be omitted.

Fourth Embodiment

A fourth embodiment will be described.

Figure 7:
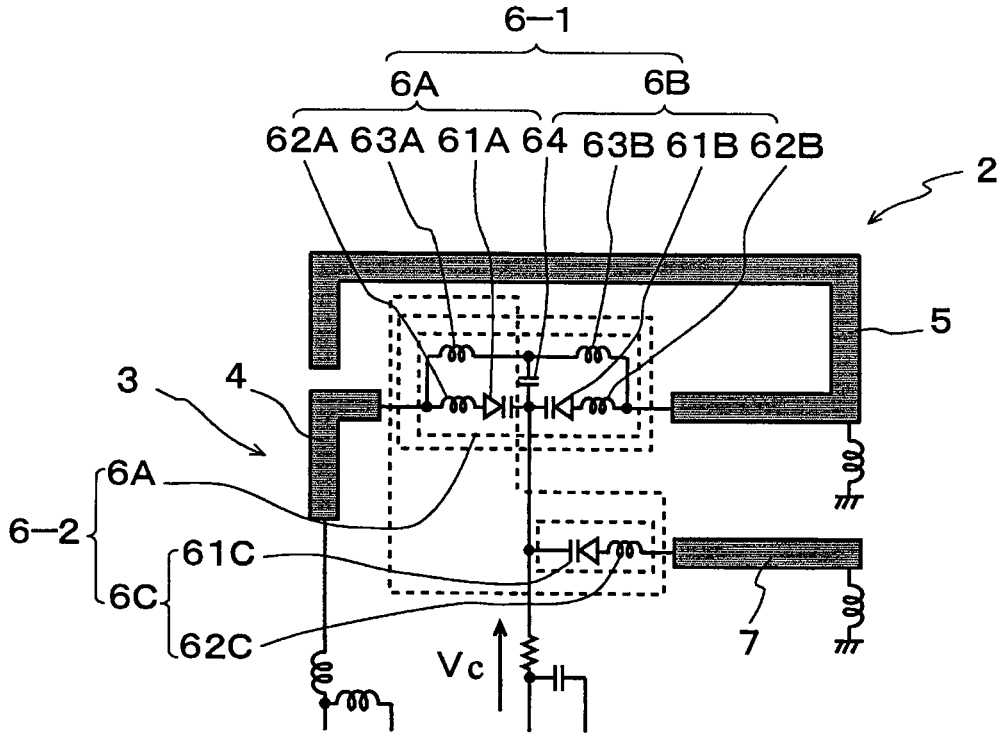
FIG. 7 is a schematic plan view showing an antenna device according to a fourth embodiment.

FIG. 7 is a schematic plan view showing an antenna device according to the fourth embodiment.

In the antenna device according to this embodiment, a series resonant circuit and a parallel resonant circuit are each applied to specific ones of the first reactance circuit 6A, the second reactance circuit 6B, and the third reactance circuit 6C used in the first embodiment.

That is, as shown in FIG. 7, the first reactance circuit 6A and the second reactance circuit 6B are configured as a parallel resonant circuit including the first variable-capacitance diode 61A and a parallel resonant circuit including the second variable-capacitance diode 61B, respectively. The third reactance circuit 6C is configured as a series resonant circuit including the third variable-capacitance diode 61C.

Operations and advantages of the antenna device according to this embodiment will be described.

Figure 8:
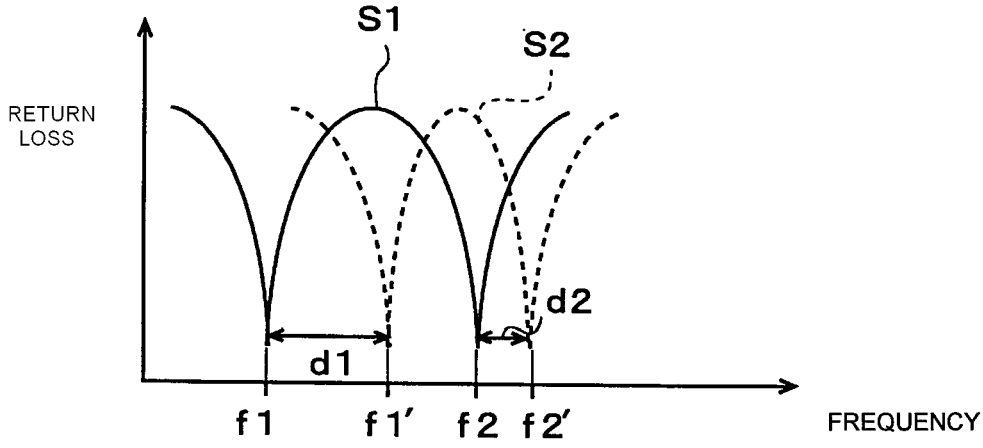
FIG. 8 is a chart illustrating a variable state of two resonances.

FIG. 8 is a chart illustrating a variable state of two resonances.

As shown by a return-loss curve S1 represented by a solid line shown in FIG. 8, the antenna device according to this embodiment also achieves two resonances f1 and f2 caused by the first and second antenna units 2 and 3. Applying a control voltage Vc to each of the first and second frequency-variable circuits 6-1 and 6-2 varies the resonant frequency f1 of the first antenna unit 2 and the resonant frequency f2 of the second antenna unit 3 at the same time.

In the first frequency-variable circuit 6-1 including the first reactance circuit 6A and the second reactance circuit 6B, which are configured as parallel resonant circuits, the reactance with respect to the control voltage Vc varies nonlinearly, as described above. Thus, although a large gain is not achieved, the amount of change d1 from the resonant frequency f1 to the resonant frequency f1' is significantly large, as shown in FIG. 8. In the third reactance circuit 6C, which is a series resonant circuit, the reactance with respect to the control voltage Vc varies linearly. Thus, although a large amount of change in the reactance is not achieved, a large gain can be obtained. As a result, the amount of change d2 from the resonant frequency f2 to the resonant frequency f2' by the second frequency-variable circuit 6-2, which includes the first reactance circuit 6A configured as a parallel resonant circuit and the third reactance circuit 6C configured as a series resonant circuit, is small.

That is, according to this embodiment, an antenna device that is capable of achieving a large amount of change d1 of the resonant frequency f1 and ensuring a certain amount of change d2 of the resonant frequency f2 while obtaining a large gain can be achieved.

The antenna device including the first reactance circuit 6A and the second reactance circuit 6B, which are configured as parallel resonant circuits, and the third reactance circuit 6C, which is configured as a series resonant circuit, has been explained in this embodiment. However, the present invention is not limited to this. Determination of which reactance circuit is to be configured as a parallel resonant circuit and determination of which reactance circuit is to be configured as a series resonant circuit can be performed in accordance with which of the variation width of a resonant frequency band or the gain is to be emphasized.

Since the other configurations, operations, and advantages of the antenna device according to this embodiment are similar to those of the antenna devices according to the second and third embodiments, the description of those similar configurations, operations, and advantages will be omitted.

Fifth Embodiment

A fifth embodiment will be described.

Figure 9:
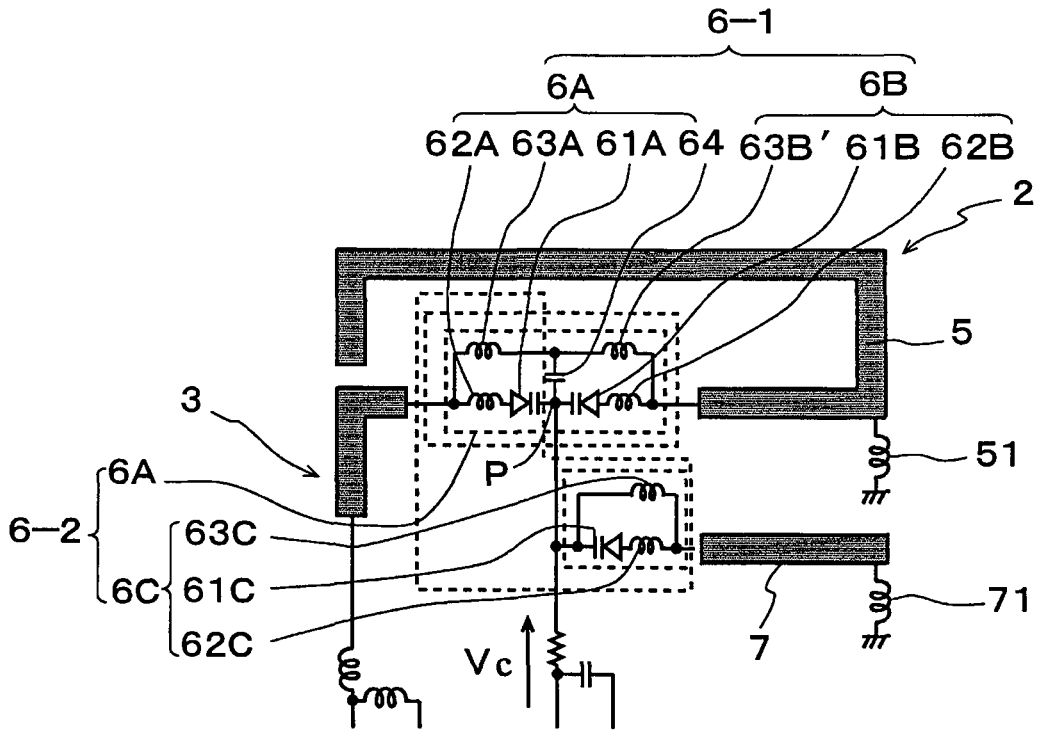
FIG. 9 is a schematic plan view showing an antenna device according to a fifth embodiment.
Figure 10:
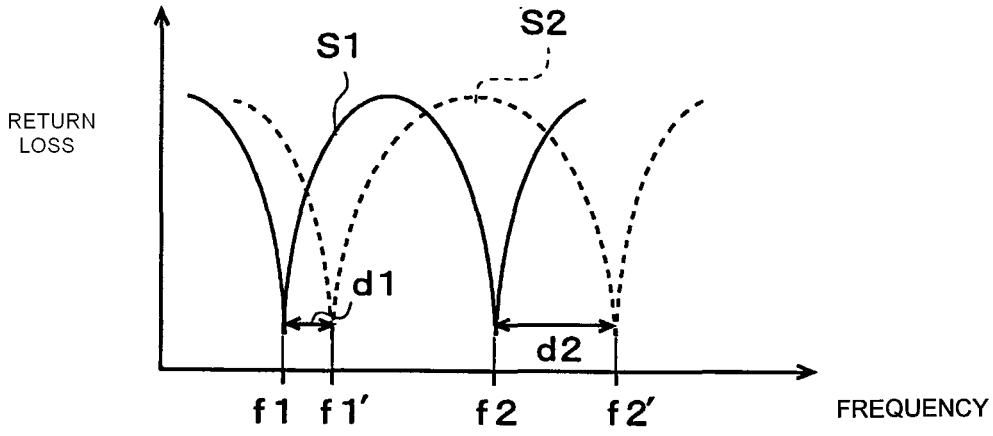
FIG. 10 is a chart illustrating a variable state of two resonances.

FIG. 9 is a schematic plan view showing an antenna device according to the fifth embodiment. FIG. 10 is a chart illustrating a variable state of two resonances.

The antenna device according to this embodiment has a configuration in which both a series resonant circuit and a parallel resonant circuit are applied to the first reactance circuit 6A, the second reactance circuit 6B, and the third reactance circuit 6C, as in the fourth embodiment. However, the antenna device according to this embodiment is different from the antenna device according to the fourth embodiment in that a series resonant circuit is formed using a choke coil.

That is, as shown in FIG. 9, the first reactance circuit 6A, the second reactance circuit 6B, and the third reactance circuit 6C are configured as parallel circuits. By using a choke coil as a coil of the second reactance circuit 6B, the second reactance circuit 6B is substantially capable of serving as a series resonant circuit.

More specifically, the second reactance circuit 6B is formed by connecting a series circuit including the common capacitor 64 and a coil 63B' in parallel to the series circuit including the second variable-capacitance diode 61B and the coil 62B. The coil 63B' is set as a choke coil for cutting off electric power having an in-band frequency of the first antenna unit 2. The coil 63B' can be set as a choke coil by adjusting the inductance of the coil 63B'. That is, the second reactance circuit 6B is substantially configured so as to function as a series resonant circuit including the first variable-capacitance diode 61A and the coil 62B.

With this configuration, as shown by a return-loss curve S1 represented by a solid line and a return-loss curve S2 represented by a broken line shown in FIG. 10, the first frequency-variable circuit 6-1 achieves a large gain while ensuring a certain amount of change d1 of the resonant frequency f1 and the second frequency-variable circuit 6-2 achieves a large amount of change d2 of the resonant frequency f2.

As described above, according to this embodiment, all the first to third reactance circuits 6A to 6C are designed as parallel circuits, and one of the coils 63A to 63C is set as a choke coil by adjusting the inductance of the one of the coils 63A to 63C according to the situation. Thus, a parallel circuit including the choke coil functions substantially as a series resonant circuit. Consequently, design can be changed easily without requiring reconfiguration of a parallel circuit portion into a series resonant circuit.

Since the other configurations, operations, and advantages of the antenna device according to this embodiment are similar to those of the antenna device according to the fourth embodiment, the description of those similar configurations, operations, and advantages will be omitted.

Sixth Embodiment

A sixth embodiment will be described.

Figure 11:
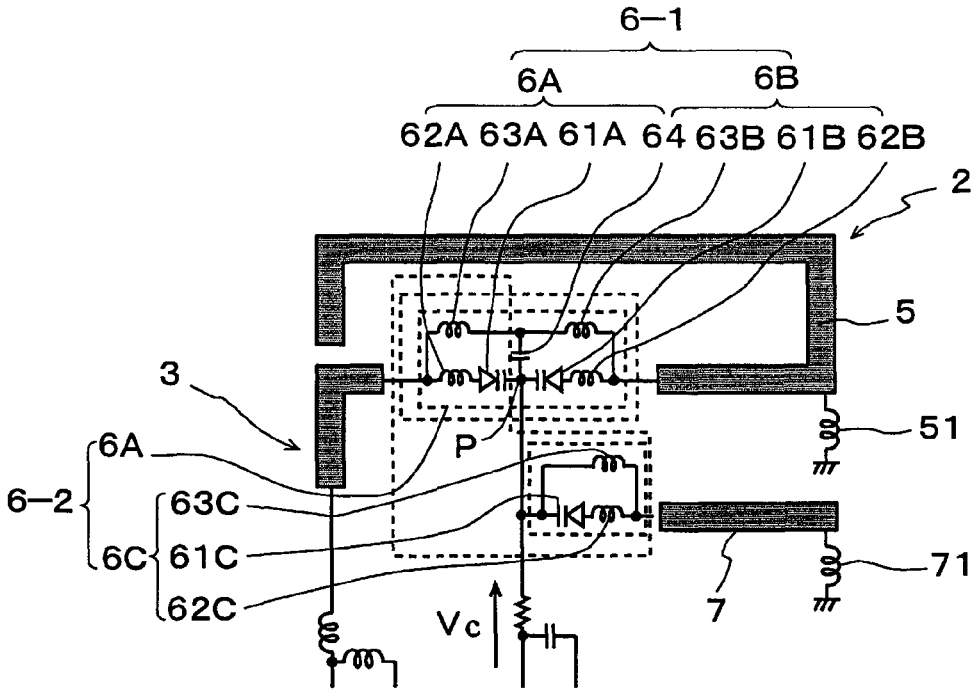
FIG. 11 is a schematic plan view showing an antenna device according to a sixth embodiment.

FIG. 11 is a schematic plan view showing an antenna device according to the sixth embodiment.

In the antenna device according to this embodiment, all of the first reactance circuit 6A, the second reactance circuit 6B, and the third reactance circuit 6C are configured as parallel resonant circuits, as in the third embodiment. However, the antenna device according to this embodiment is different from the antenna devices according to the third to fifth embodiments in that functions similar to functions attained in a case where a series resonant circuit and a parallel resonant circuit are applied to the first to third reactance circuits 6A to 6C can be attained by using an internal resistance of a variable-capacitance diode.

Figure 12:
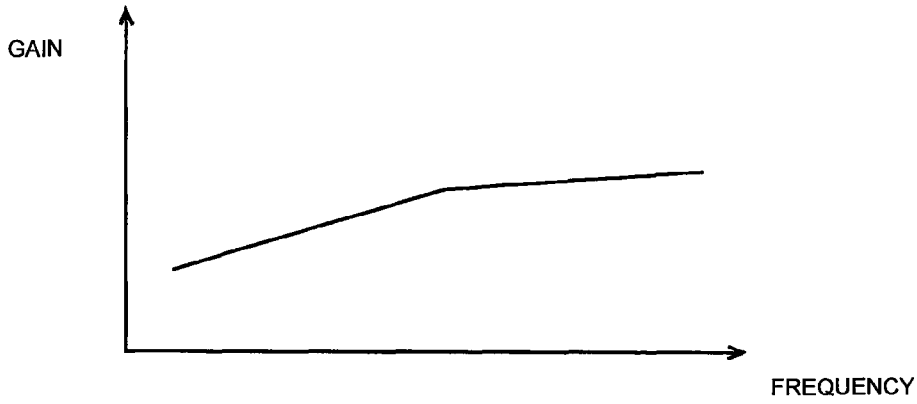
FIG. 12 is a chart illustrating the relationship between a frequency and a gain when a variable-capacitance diode has a large internal resistance.
Figure 13:
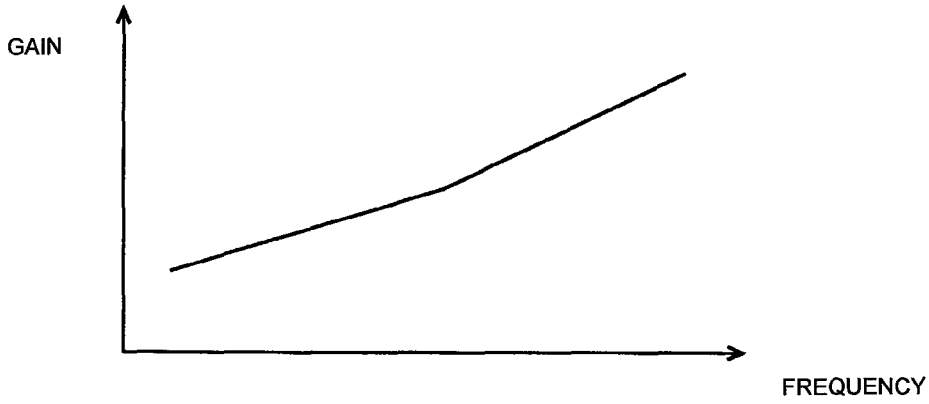
FIG. 13 is a chart illustrating the relationship between a frequency and a gain when a variable-capacitance diode has a small internal resistance.

FIG. 12 is a chart illustrating the relationship between the frequency and the gain when a variable-capacitance diode has a large internal resistance. FIG. 13 is a chart illustrating the relationship between the frequency and the gain when a variable-capacitance diode has a small internal resistance.

Each variable-capacitance diode has an internal resistance that is characteristic of the diode. As shown in FIG. 12, the larger the internal resistance of a variable-capacitance diode is, the smaller the gain is. However, when such a variable-capacitance diode is used, a variable-capacitance range is increased. In contrast, the smaller the internal resistance is, the larger the gain is, as shown in FIG. 13. However, when such a variable-capacitance diode is used, a variable capacitance range is reduced.

The antenna device according to this embodiment utilizes such characteristics of variable-capacitance diodes. The internal resistances Ra, Rb, and Rc of the first variable-capacitance diode 61A, the second variable-capacitance diode 61B, and the third variable-capacitance diode 61C are set to Ra>Rb>Rc.

With this configuration, the first frequency-variable circuit 6-1 is capable of varying the resonant frequency f1 of the first antenna unit 2 over a wide range and the second frequency-variable circuit 6-2 is capable of varying the resonant frequency f2 over a predetermined range and obtaining a large gain.

In this embodiment, the internal resistances Ra, Rb, and Rc of the first variable-capacitance diode 61A, the second variable-capacitance diode 61B, and the third variable-capacitance diode 61C are set to Ra>Rb>Rc. However, the values of the internal resistances can be determined depending on which of a frequency variable range or a gain is to be emphasized.

Thus, when all the internal resistances Ra to Rc are set to the same large value, the first and second frequency-variable circuits 6-1 and 6-2 are capable of achieving a wide variable range for the resonant frequencies f1 and f2. When all the internal resistances Ra to Rc are set to the same small value, a large gain can be achieved in each of the first antenna unit 2 and the second antenna unit 3. In addition, when at least one of the internal resistances Ra to Rc is set to be different from the others of the internal resistances Ra to Rc in an appropriate manner, optimal characteristics of the first and second antenna units 2 and 3 can be achieved according to the situation.

Since the other configurations, operations, and advantages of the antenna device according to this embodiment are similar to those of the antenna devices according to the second to fifth embodiments, the description of those similar configurations, operations, and advantages will be omitted.

Seventh Embodiment

A seventh embodiment will be described.

Figure 14:
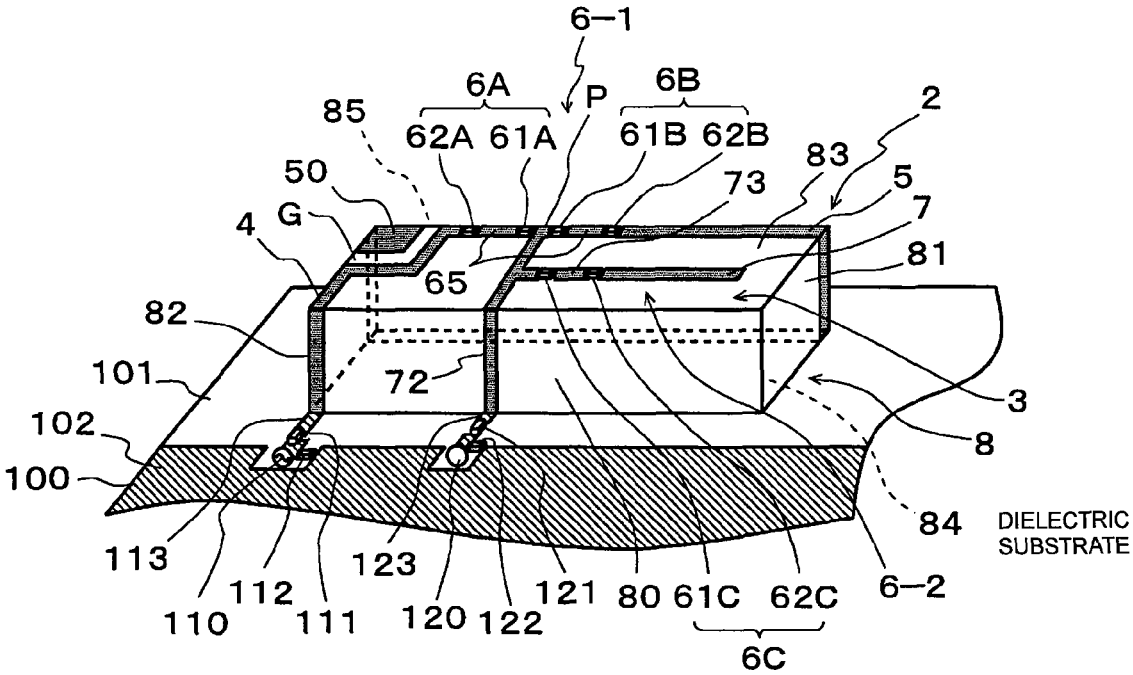
FIG. 14 is a perspective view showing an antenna device according to a seventh embodiment.

FIG. 14 is a perspective view showing an antenna device according to a seventh embodiment.

As shown in FIG. 14, the antenna device according to this embodiment is different from the antenna devices according to the first to sixth embodiments in that the first antenna unit 2 and the second antenna unit 3 are formed on a dielectric substrate 8.

More specifically, the dielectric substrate 8 is a rectangular parallelepiped and includes a front face 80, side faces 81 and 82, an upper face 83, a lower face 84, and a rear face 85. The dielectric substrate 8 is provided in the non-ground region 101 of the circuit board 100.

The feed electrode 4 of the first antenna unit 2 is pattern-formed on the front face 80 and the upper face 83 of the dielectric substrate 8. A pattern 113 is formed in the non-ground region 101. One end of the feed electrode 4 is connected to the transmitter/receiver 110 through the pattern 113 and the coil 111. The other end of the feed electrode 4 is connected to the first frequency-variable circuit 6-1. Each of the first reactance circuit 6A and the second reactance circuit 6B of the first frequency-variable circuit 6-1 is a series resonant circuit. The first variable-capacitance diode 61A (the second variable-capacitance diode 61B) and the coil 62A (62B) are chip components and are connected to each other through a pattern 65 provided on the upper face 83 of the dielectric substrate 8.

The first radiation electrode 5 is connected to the coil 62B of the first frequency-variable circuit 6-1. The first radiation electrode 5 extends rightward in an upper portion of the upper face 83 of the dielectric substrate 8, goes down along the side face 81, extends leftward along the lower face 84, and goes up along the side face 82. Then, the open end 50 of the first radiation electrode 5 is positioned at a corner of the upper face 83.

A pattern 72 is extracted from the connection point P of the first frequency-variable circuit 6-1. The pattern 72 extends along the upper face 83 and the front face 80, and is connected to a pattern 123, which is formed in the non-ground region 101 and reaches the reception-frequency controller 120. The high-frequency cutoff resistor 121 and the DC-pass capacitor 122 are connected in the middle of the pattern 123.

The second radiation electrode 7 of the second antenna unit 3 is pattern-formed on the upper face 83 of the dielectric substrate 8 and faces a direction perpendicular to the pattern 72. The second radiation electrode 7 is connected to the pattern 72 through the second frequency-variable circuit 6-2.

The third reactance circuit 6C of the second frequency-variable circuit 6-2 is a series resonant circuit. The third variable-capacitance diode 61C and the coil 62C are chip components and are connected to each other through a pattern 73 provided on the upper face 83 of the dielectric substrate 8.

With this configuration, the capacitance between the open end 50 of the first radiation electrode 5 and the feed electrode 4 of the first antenna unit 2 and the capacitance between the first radiation electrode 5 and the second radiation electrode 7 can be increased. Thus, by changing the dielectric constant of the dielectric substrate 8 in an appropriate manner, the reactances of the first and second antenna units 2 and 3 can be adjusted.

In this embodiment, both of the first antenna unit 2 and the second antenna unit 3 are formed on the dielectric substrate 8. However, only the first antenna unit 2 may be formed on the dielectric substrate 8. In this case, the second antenna unit 3 may be formed in the non-ground region 101 of the circuit board 100. Or these locations may be reversed.

Since the other configurations, operations, and advantages of the antenna device according to this embodiment are similar to those of the antenna devices according to the first to sixth embodiments, the description of those similar configurations, operations, and advantages will be omitted.

Eighth Embodiment

An eighth embodiment will be described.

Figure 15:
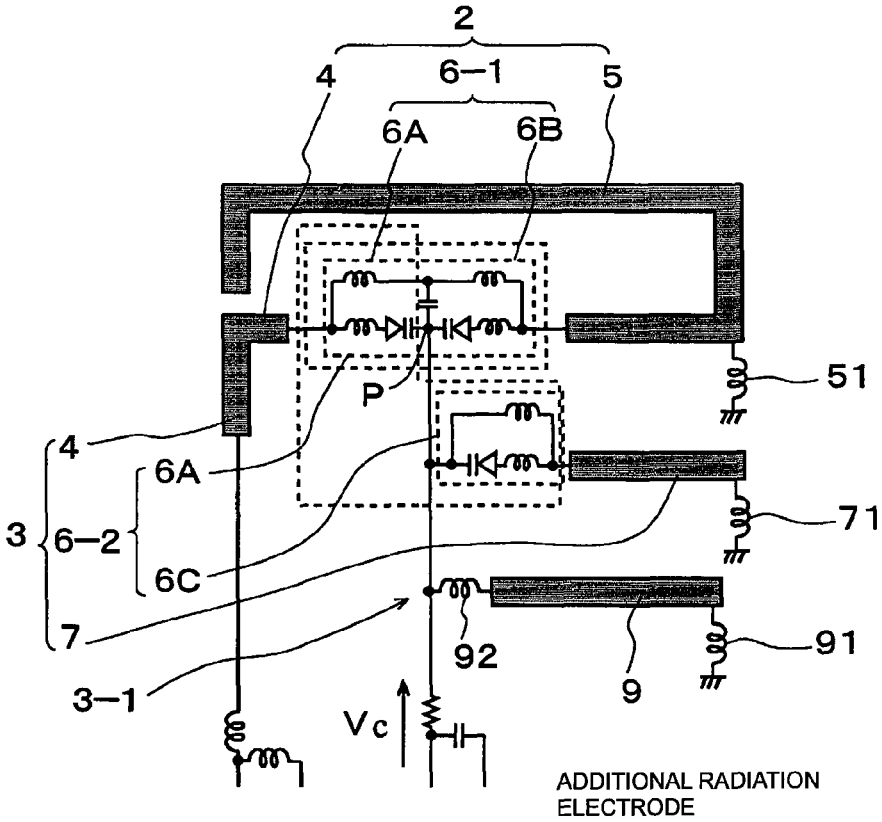
FIG. 15 is a schematic plan view showing an antenna device according to an eighth embodiment.
Figure 16:
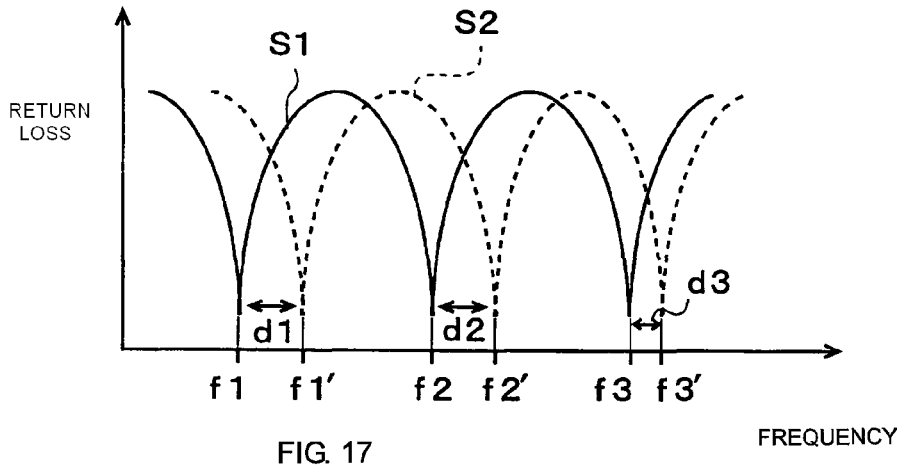
FIG. 16 is a chart illustrating a variable state of multi-resonances.

FIG. 15 is a schematic plan view showing an antenna device according to the eight embodiment. FIG. 16 is a chart illustrating a variable state of multi-resonances.

As shown in FIG. 15, the antenna device according to this embodiment is different from the antenna devices according to the first to seventh embodiments in that another antenna unit is added.

That is, an additional radiation electrode 9, to which a ground coil 91 for adjusting a resonant frequency is connected, is connected to the connection point P through a coil 92 and is disposed in the subsequent stage of the first reactance circuit 6A.

Thus, an additional antenna unit 3-1 is formed by the feed electrode 4, the first reactance circuit 6A, which is a frequency-variable circuit, and the additional radiation electrode 9.

With this configuration, as shown in FIG. 16, a resonant frequency f3 of the additional antenna unit 3-1, as well as the resonant frequencies f1 and f2 of the first and second antenna units 2 and 3, can be obtained.

By changing the reactances of the first and second frequency-variable circuits 6-1 and 6-2 and the first reactance circuit 6A due to the application of a control voltage Vc, the resonant frequencies f1, f2, and f3 of the first and second antenna units 2 and 3 and the additional antenna unit 3-1 can be changed at the same time by the amounts of change d1, d2, and d3 to the resonant frequencies f1', f2', and f3'.

Although an example in which the additional antenna unit 3-1 including the additional radiation electrode 9 is provided has been described in this embodiment, a plurality of additional radiation electrodes 9 may be connected in parallel to each other to the connection point P so that a plurality of additional antenna units 3-1 to **3-*n*** can be formed.

Since the other configurations, operations, and advantages of the antenna device according to this embodiment are similar to those of the antenna devices according to the first to seventh embodiments, the description of those similar configurations, operations, and advantages will be omitted.

Ninth Embodiment

A ninth embodiment will be described.

Figure 17:
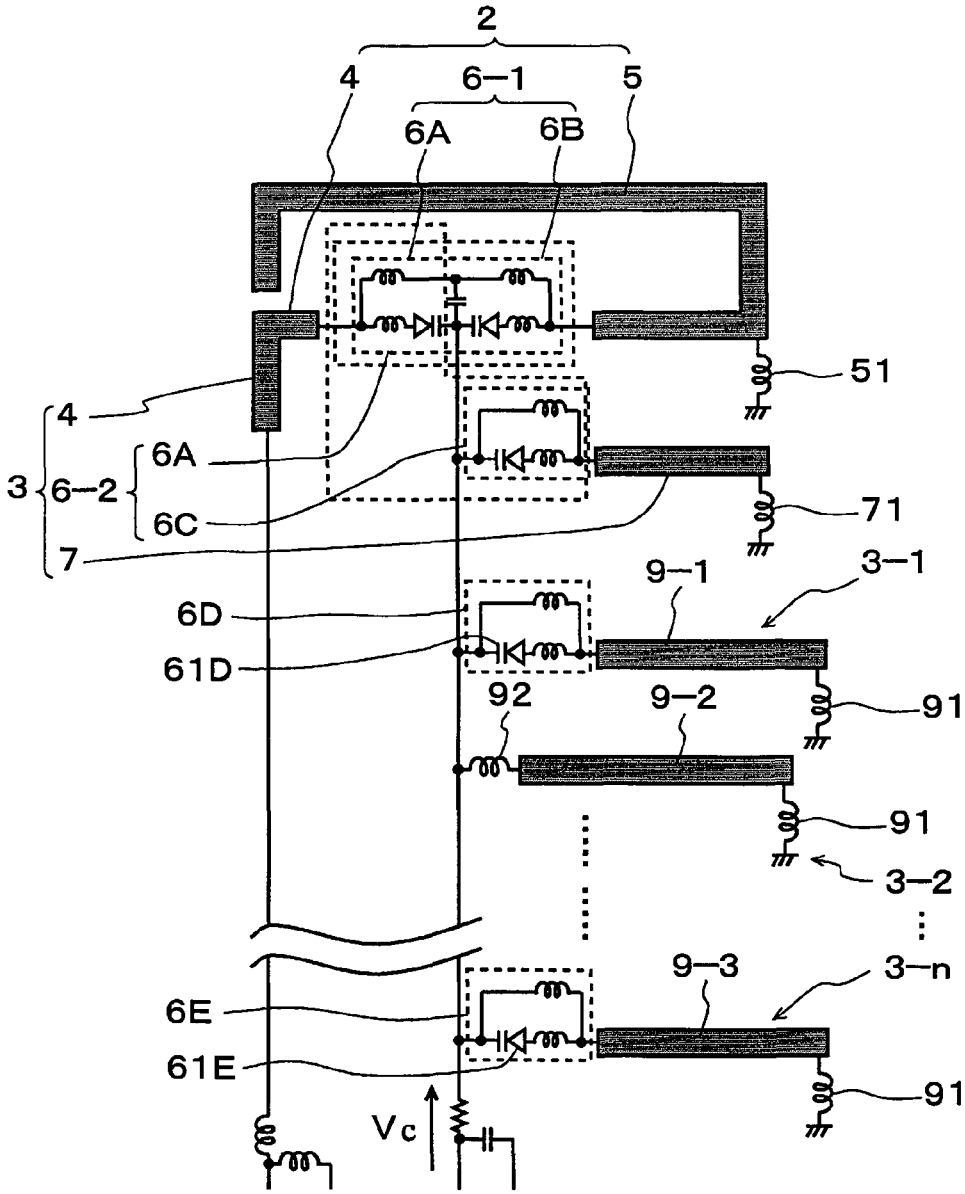
FIG. 17 is a schematic plan view showing an antenna device according to a ninth embodiment of the present invention.
Figure 18:
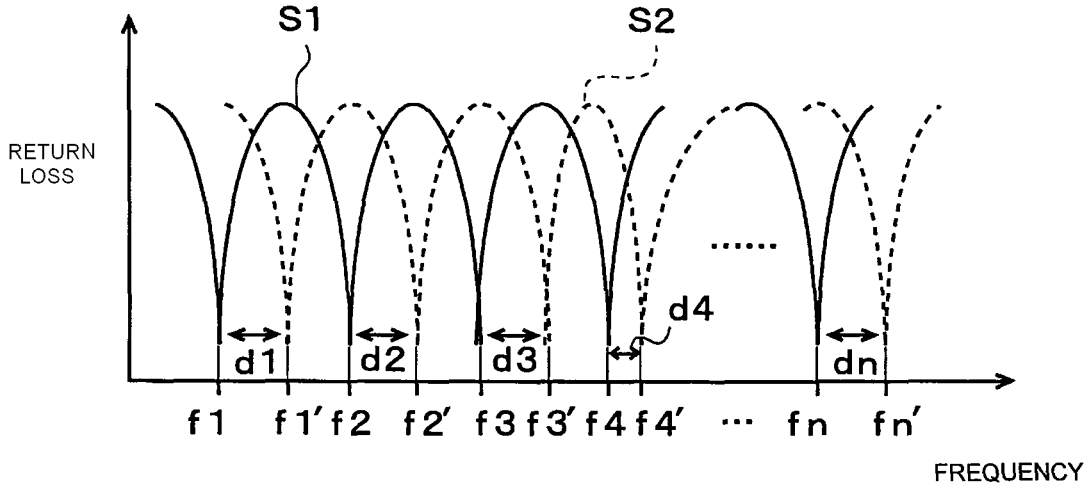
FIG. 18 is a chart illustrating a variable state of multi-resonances.

FIG. 17 is a schematic plan view showing an antenna device according to the ninth embodiment. FIG. 18 is a chart illustrating a variable state of multi-resonances.

As shown in FIG. 17, the antenna device according to this embodiment is different from the antenna device according to the eighth embodiment in that a reactance circuit is added to at least one of n additional antenna units 3-1 to **3-*n***.

That is, n additional antenna units 3-1 to **3-*n* are provided, and an additional reactance circuit is provided in at least one of the n additional antenna units 3-1**.

More specifically, an additional reactance circuit 6D including a variable-capacitance diode 61D whose capacitance can be varied by a control voltage Vc is connected between the first reactance circuit 6A and an additional radiation electrode 9-1, and a frequency-variable circuit is formed by the first reactance circuit 6A and the additional reactance circuit 6D. That is, the additional antenna unit 3-1 is formed by the frequency-variable circuit, the additional radiation electrode 9-1, and the feed electrode 4.

In the additional antenna unit 3-2, the coil 92 is connected to an additional radiation electrode 9-2, as in the eighth embodiment, however no additional reactance circuit is connected. Thus, the additional antenna unit 3-2 is formed by the feed electrode 4, the first reactance circuit 6A, and the additional radiation electrode 9-2.

In the subsequent additional antenna units, an additional reactance circuit is provided when necessary. In the additional antenna unit **3-*n*, which is in the last stage, an additional reactance circuit 6E is connected to an additional radiation electrode 9-3. That is, a frequency-variable circuit is formed by the first reactance circuit 6A and the additional reactance circuit 6E. Accordingly, the additional antenna unit 3-*n* is formed by the feed electrode 4, the frequency-variable circuit, and the additional radiation electrode 9-3**.

With this configuration, as shown by a return-loss curve S1 represented by a solid line shown in FIG. 18, the resonant frequencies f1 and f2 of the first and second antenna units 2 and 3 and the resonant frequencies f3 to fn of the additional antenna units 3-1 to **3-*n*** can be obtained.

As shown by a return-loss curve S2 represented by a broken line, the resonant frequencies f1, f2, 3, f4, . . . , and fn of the first and second antenna units 2 and 3 and the additional antenna units 3-1, 3-2, . . . , and **3-*n* are changed at the same time by the amounts of change d1, d2, d3, d4, . . . , and dn to the resonant frequencies f1', f2', f3', f4'**, . . . , and fn'.

Since the frequency-variable circuits of the additional antenna units 3-1 and **3-*n* have two reactance circuits (the first reactance circuit 6A and the additional reactance circuit 6D; and the first reactance circuit 6A and the additional reactance circuit 6E), the amounts of change d3 and dn from the resonant frequencies f3 and fn to the resonant frequencies f3' and fn' are greater than the amount of change d4 from the resonant frequency f4 to the resonant frequency f4' of the additional antenna unit 3-2, which includes only a single reactance circuit (the first reactance circuit 6**A).

Since the other configurations, operations, and advantages of the antenna device according to this embodiment are similar to those of the antenna device according to the eighth embodiment, the description of those similar configurations, operations, and advantages will be omitted.

Although particular embodiments have been described, many other variations and modifications and other uses will become apparent to those skilled in the art. Therefore, the present invention is not limited by the specific disclosure herein.

What is claimed is:

1. An antenna device comprising:

a first antenna unit including a feed electrode, a first radiation electrode, and a first frequency-variable circuit connected between the first radiation electrode and the feed electrode; and a second antenna unit including the feed electrode, a second radiation electrode, and a second frequency-variable circuit connected between the second radiation electrode and the feed electrode; wherein the first frequency-variable circuit includes a first reactance circuit connected to the feed electrode, the first reactance circuit consisting of a first coil connected in series with a first variable-capacitance diode whose capacitance is variable using a control voltage; and a second reactance circuit connected between the first reactance circuit and the first radiation electrode, the second reactance circuit consisting of a second coil connected in series with a second variable-capacitance diode whose capacitance is variable using the control voltage;

the second frequency-variable circuit includes the first reactance circuit; and a third reactance circuit connected between the first reactance circuit and the second radiation electrode, the third reactance circuit consisting of a third coil connected in series with a third variable-capacitance diode whose capacitance is variable using the control voltage; and the first radiation electrode has a loop shape and includes an open end that faces the feed electrode with a gap therebetween, a reactance of the first antenna unit is provided by the gap between the open end of the first radiation electrode and the feed electrode; wherein cathodes of the first, second, and third variable-capacitance diodes are connected to each other, and the control voltage is configured to be applied where the cathodes are connected to each other.

2. The antenna device according to claim 1, wherein an internal resistance of at least one of the first to third variable-capacitance diodes is different from internal resistances of the others of the first to third variable-capacitance diodes.

3. The antenna device according to claim 1, further comprising an additional antenna unit including an additional radiation electrode, the feed electrode, and the first reactance circuit.

4. The antenna device according to claim 1, comprising: a plurality of additional antenna units; and at least one of the plurality of additional antenna units comprises an additional radiation electrode, and an additional reactance circuit including a variable-capacitance diode whose capacitance is variable using the control voltage; said additional reactance unit being connected between the first reactance circuit and the corresponding additional radiation electrode, and a frequency-variable circuit of said at least one of the plurality of additional antenna units is formed by the additional reactance circuit and the first reactance circuit.

5. A wireless communication apparatus comprising:

an antenna device comprising:

a first antenna unit including a feed electrode, a first radiation electrode, and a first frequency-variable circuit connected between the first radiation electrode and the feed electrode; and a second antenna unit including the feed electrode, a second radiation electrode, and a second frequency-variable circuit connected between the second radiation electrode and the feed electrode; wherein the first frequency-variable circuit includes a first reactance circuit connected to the feed electrode, the first reactance circuit consisting of a first coil connected in series with a first variable-capacitance diode whose capacitance is variable using a control voltage; and a second reactance circuit connected between the first reactance circuit and the first radiation electrode, the second reactance circuit consisting of a second coil connected in series with a second variable-capacitance diode whose capacitance is variable using the control voltage; the second frequency-variable circuit includes the first reactance circuit; and a third reactance circuit connected between the first reactance circuit and the second radiation electrode, the third reactance circuit consisting of a third coil connected in series with a third variable-capacitance diode whose capacitance is variable using the control voltage; and the first radiation electrode has a loop shape and includes an open end that faces the feed electrode with a gap therebetween, a reactance of the first antenna unit is provided by the gap between the open end of the first radiation electrode and the feed electrode; wherein cathodes of the first, second, and third variable-capacitance diodes are connected to each other, and the control voltage is configured to be applied where the cathodes are connected to each other; and at least one of a transmitter or a receiver connected to the feed electrode.

6. A wireless communication apparatus according to claim 5, further comprising a frequency controller supplying said control voltage to said antenna device.

* * * * *